United States Patent [19]

Dittman et al.

[11] 4,366,452

[45] Dec. 28, 1982

[54] MULTI-POSITION WAVEGUIDE SWITCH

[75] Inventors: William J. Dittman, Marietta; Calvin R. Jameson, Atlanta, both of Ga.

[73] Assignee: Georgia Tech Research Institute, Atlanta, Ga.

[21] Appl. No.: 224,371

[22] Filed: Jan. 12, 1981

[51] Int. Cl.[3] ..... H01P 1/10

[52] U.S. Cl. ..... 333/108; 200/153 S; 333/259

[58] Field of Search ..... 333/105–108, 333/259; 200/61.86, 153 S

[56] References Cited

U.S. PATENT DOCUMENTS

| | | | |
|---|---|---|---|
| 2,629,048 | 2/1953 | Duke et al. . | |
| 2,773,242 | 12/1956 | Grieg | 333/105 |
| 3,077,568 | 2/1963 | Kelsey | 333/106 |
| 3,157,844 | 11/1964 | Lanatot . | |
| 4,060,781 | 11/1977 | Hudspeth et al. . | |
| 4,151,489 | 4/1979 | Berman et al. . | |

*Primary Examiner*—Paul L. Gensler

*Attorney, Agent, or Firm*—Newton, Hopkins & Ormsby

[57] ABSTRACT

A multi-position waveguide switch including a cylindrical housing supporting radially extending waveguides, a switching assembly composed of a stack of disks each having input and output ports interconnected by waveguide sections, and a mechanism for selectively translating the stack of disks to selected axial positions within the cylindrical housing such that a selected disk is in alignment and communication with certain predetermined ports of the radially extending waveguides. By selective axial translation of the disk assembly, a selected disk may be interposed between the radially extending waveguide supported by the housing to provide a selected routing path for microwave energy to the waveguides supported by the housing and through the selected disk.

2 Claims, 9 Drawing Figures

MULTI-POSITION WAVEGUIDE SWITCH

The Government has rights in this invention pursuant to contract Nr. DAAK40-77-C-0088, awarded by the Department of the Army.

BACKGROUND OF THE INVENTION

1. Field of the Invention

This invention relates to a multi-position waveguide switch capable of coupling microwave energy from an input waveguide to any one of plural output waveguides or to any combination of output waveguides.

2. Description of the Prior Art

Microwave switches are generally known in the prior art, and typically employ a rotatable disk inside a clylinder having a radially extending waveguide attached to the cylinder wall in the plane of the rotatable disk. The rotatable disk is provided with internal waveguide channels having end ports disposed radially on the periphery of the disk to be placed in alignment with corresponding waveguides in the cylinder, thereby to achieve a coupling of selected external waveguides dependent upon the position of the rotatable disk. Typically, rotation of the disk is accomplished either manually or by a motor driven geneva mechanism or solenoid, which serves to align the radial parts of the disk with the external waveguides attached to the cylinder. However, it has been found that a relatively large motor and driving mechanism is needed to achieve a fast switching time using the conventional waveguide switch. Furthermore, the conventional waveguide switch employing a rotatable disk is restricted to a simple waveguide channel design in the interior of the disk, usually limited to a maximum of three channels, resulting in at most a three-way, four-port switch.

A good example of a prior art waveguide switch is found in U.S. Pat. No. 4,151,489 to Berman et al., wherein a four-port waveguide switch which allows any two pairs of ports to be interconnected is described. Other waveguide switches in the prior art utilizing rotatable switching mechanisms are found in U.S. Pat. No. 4,060,781 to Hudspeth et al., U.S. Pat. No. 3,157,844 to Lanctot, and U.S. Pat. No. 2,629,048 to Dyke et al.

Examples of other prior art of interest in which is disclosed various microwave switching techniques can be found in U.S. Pat. Nos. 4,185,287; 4,061,989; 3,940,584; 3,342,966; 3,153,129; and 3,121,840.

SUMMARY OF THE INVENTION

Accordingly, one object of this invention is to provide a new and improved multi-position waveguide switch characterized by simplicity of construction.

Another object of this invention is to provide a novel multi-position waveguide switch which enables a large number of switching combinations.

Yet another object of this invention is to provide a novel multi-position waveguide switch capable of achieving fast switching times.

A further object of this invention is to provide a novel multi-position waveguide switch which can be switched from position to position using a relatively low power drive mechanism.

These and other objects are achieved according to the invention by providing a new and improved multi-position waveguide switch in the form of a housing, preferably cylindrical but not necessarily, defining a longitudinal axis and having plural ports in communication with respective waveguides extending from the housing. Disposed within the housing is a waveguide switching assembly in the form of plural waveguide channels each having at least one input port and at least one output port, wherein at least two of the channels are displaced axially a predetermined distance with respect to each other. The input and output ports of the waveguide switching assembly ae positioned relative to predetermined of the housing ports such that upon axial translation of the waveguide switching assembly, the input and output ports thereof are aligned and in communication with predetermined of the housing ports. Coupled to the waveguide switching assembly is an axial translation device for selectively translating the waveguide switching assembly such that selected of the input and output ports thereof are aligned and in communication with predetermined of the housing ports.

In a preferred embodiment, the waveguide switching assembly is implemented in the form of plural stacked disks each having at least one input port and at least one output port connected by at least one waveguide section. Preferably, but not necessarily, the input and output ports of each waveguide section are arranged in a common plane transverse to the longitudinal axis of the housing. Each disk, when aligned with the housing ports defines a unique waveguide switching configuration for routing R.F. energy from at least one housing port through the disk to at least one other housing port.

In the preferred embodiment of the invention, the translating device includes a pair of guide rods disposed in the housing parallel to the longitudinal axis thereof and coupling the waveguide switching assembly for guiding the axial translation of this assembly. A spring coupling the housing in the waveguide assembly is then provided for biasing the assembly in a first direction and at least one air cylinder having a piston coupled to the waveguide switching assembly is adapted to be connected to a source of pressurized air such that upon application of pressurized air thereto, the piston and the assembly undergoes a predetermined translation in a second direction opposite the first direction. Typically, plural air cylinders are provided, each having a piston coupled to the waveguide switching assembly, wherein each piston has a respective stroke such that upon selective application of pressurized air to a selected air cylinder, there is produced a predetermined translation of the respective piston and the waveguide assembly coupled thereto in dependence upon the stroke of the respective piston.

According to the invention, the input and output ports of the waveguide switching assembly are arranged in groups wherein the input ports of each group have an identical spatial relationship such that corresponding input ports of each group are aligned with respective housing ports upon axial translation of the waveguide switching assembly, with the input ports of each group positioned to couple predetermined housing ports to define a unique switching configuration through the housing for each group of input and output ports of the waveguide switching assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
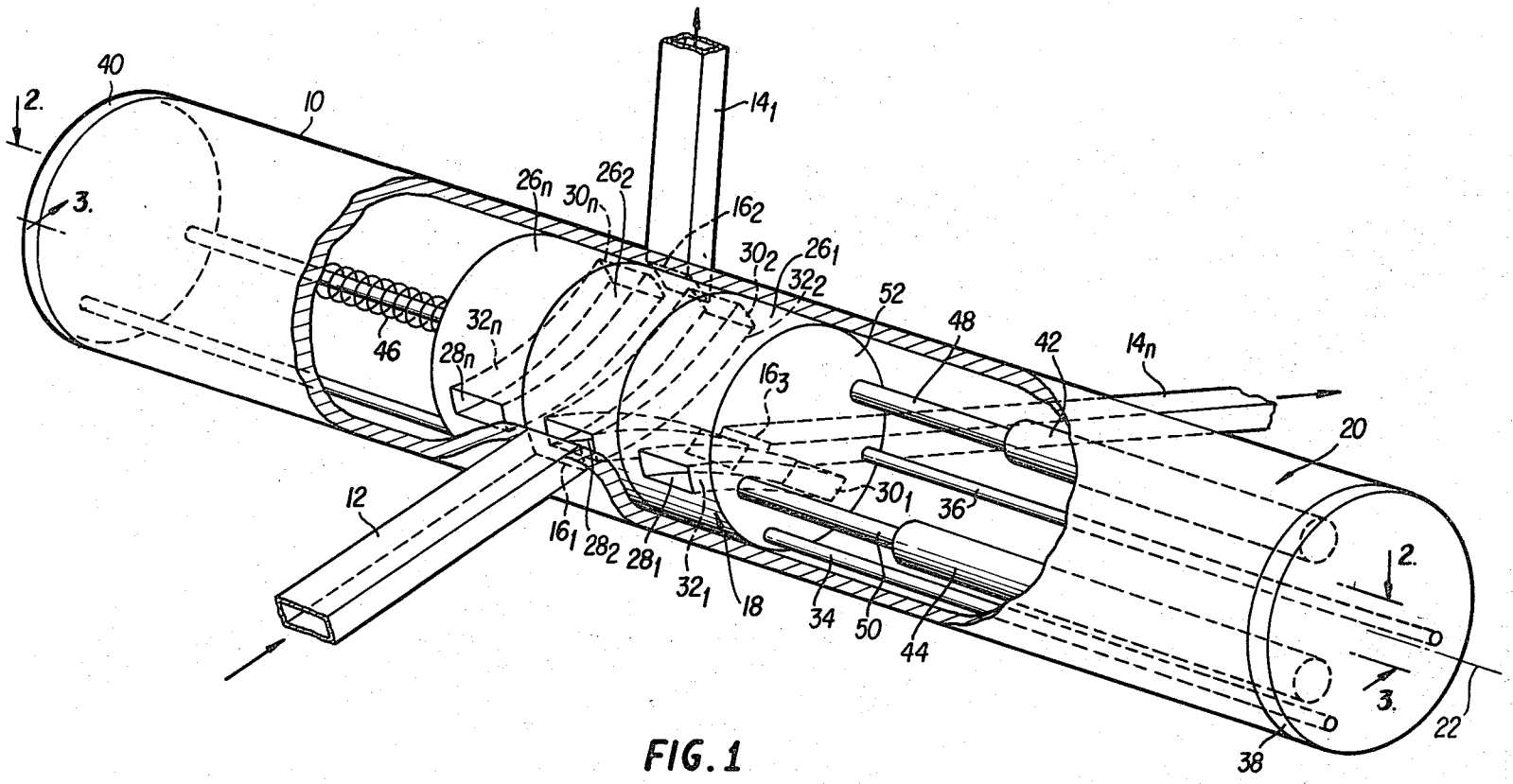
FIG. 1 is a perspective view partially in section illustrating the multi-position waveguide switch according to the invention.

Referring now to the drawings, wherein like reference numerals designate identical or corresponding parts throughout the several views, and more particularly to FIG. 1 thereof, the multi-position waveguide switch of the invention is formed of three major components, including: a cylindrical housing 10 supporting plural radially extending waveguides including at least one input waveguide 12 and a pair of output waveguides $\mathbf{14}_1$, $\mathbf{14}_n$ communicating with the interior of the housing 10 by means of respective ports 16; an internal waveguide switching assembly 18 disposed within the housing 10; and a mechanism 20 for producing an axial translation of the waveguide switching assembly 18 along the longitudinal axis 22 of the housing 10.

In a preferred embodiment, the housing 10 is a hollow cylinder having a plurality of rectangular ports 16 radially disposed in a common plane transverse to the longitudinal axis 22 of the cylindrical housing 10, approximately midway the length of the housing 10. In the preferred embodiment shown in FIG. 1, the waveguide switching assembly is composed of a stack of disks $\mathbf{26}_1$, $\mathbf{26}_2$, . . . $\mathbf{26}_n$, each adapted for translation along the housing longitudinal axis 22. Each of the disks $\mathbf{26}_{1-26n}$ is provided with at least one input port $\mathbf{28}_1$–$\mathbf{28}_n$, respectively, which communicate with respective output ports $\mathbf{30}_1$–$\mathbf{30}_n$ via respective waveguide sections $\mathbf{32}_1$–$\mathbf{32}_n$. In this way, each of the disks 26 defines respective internal waveguide channels in the transverse plane of the disk, with the ends of the channels being disposed on the periphery of the disk in exact radial alignment with selected housing ports 16 when that particular disk 26 is axially positioned coincident with the cylinder port 16, it being noted that as shown in FIG. 1 the cylinder ports 16 are likewise disposed in a common plane transverse to the longitudinal axis 22 of the housing 10.

The waveguide switching assembly 18 formed of the stacked disks $\mathbf{26}_1$–$\mathbf{26}_n$ is slidably mounted on a pair of laterally disposed longitudinal rods 34, 36 and fits within the bore of the cylindrical housing 10 with a minimum of annular clearance. The longitudinal rods 34 and 36 are fixed in respective caps 38 and 40 attached to each end of the cylindrical housing 10. The rods 34 and 36 are disposed parallel to the longitudinal axis 22 of the housing 10 and thereby provide a guide means for the waveguide switching assembly 18, as well as a constraint against rotation of the assembly 18. The relative positioning of the longitudinal rods 34 and 36 is shown in the longitudinal cross-sectional views of the switch of the invention shown in FIGS. 2 and 3.

Figure 2:
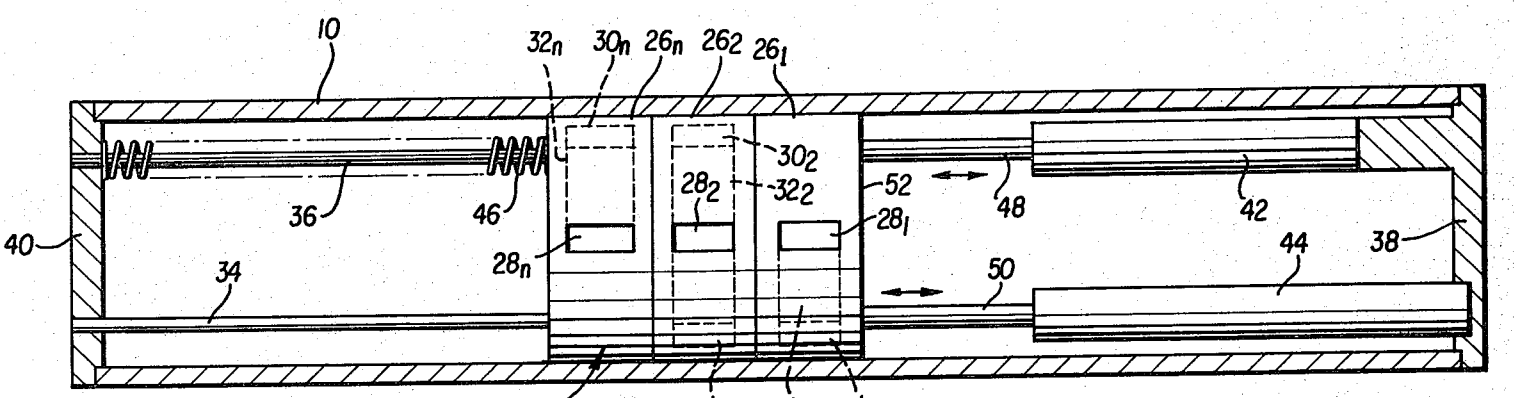
FIG. 2 is a longitudinal cross-sectional view taken along the lines 2—2 of FIG. 1.
Figure 3:
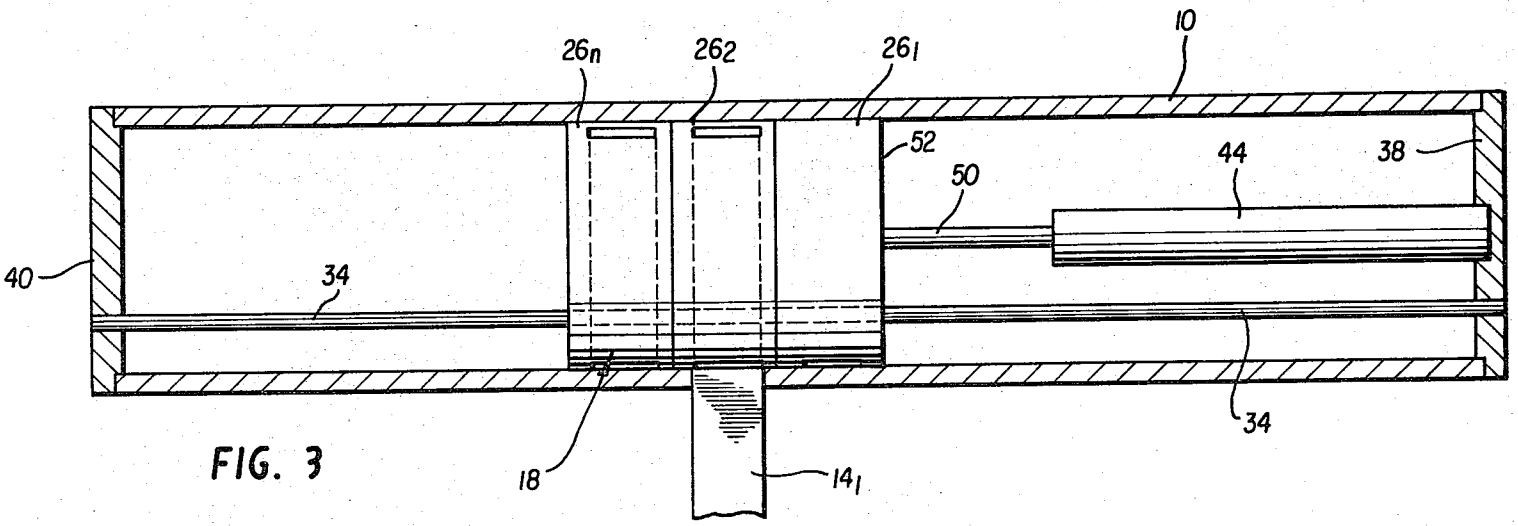
FIG. 3 is a longitudinal cross-sectional view taken along the lines 3—3 of FIG. 1.

As shown in FIG. 1, as well as in FIG. 2, the translation mechanism 20 of one embodiment of the invention is implemented by means of a pair of air cylinders 42 and 44 and a return spring 46 coacting with the waveguide switching assembly 18. Spring 46 is disposed between the cap 40 and the assembly 18 and is in a state of continuous compression tending to apply a force against the assembly 18 biasing the assembly 18 in a direction away from the cap 40 and towards the air cylinders 42 and 44. Air cylinders 42 and 44 are provided with pistons 48 and 50, respectively, with the piston 48 having a shorter stroke than that of the piston 50. In the event that the switching configuration provided by disk $\mathbf{26}_n$ is selected for operation, then neither of the pistons 48 and 40 are extended, with both pistons 48 and 50 contacting the end 52 of the disk $\mathbf{26}_1$ facing thereto. The disk assembly 18 is then maintained in position with the input port $\mathbf{28}_n$ of the disk $\mathbf{26}_n$ in communication with housing port $\mathbf{16}_1$ under the biasing provided by the return spring 46. When the switching configuration presented by disk $\mathbf{26}_2$ is selected, cylinder 42 is activated such that the disk assembly 18 is translated, partially compressing the return spring and aligning the input port $\mathbf{28}_2$ of disk $\mathbf{26}_2$ with the housing port $\mathbf{16}_1$ to achieve a second energy routing configuration as defined by the waveguide channel through the disk $\mathbf{26}_2$. Activation of the long stroke air cylinder 44 will then further translate the disk assembly 18, fully compressing the return spring 46 and aligning the input port $\mathbf{28}_1$ of the disk $\mathbf{26}_1$ with the housing port $\mathbf{16}_1$ to attain a third energy routing configuration.

Figure 4A:
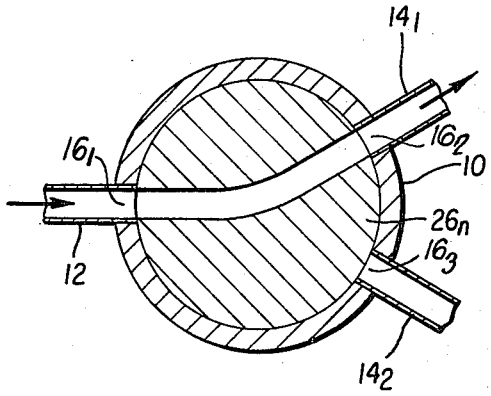
FIGS. 4*a*, 4*b* and 4*c* are semi-schematic views of three distinct waveguide switching configurations utilizing the switch shown in FIG. 1.
Figure 4B:
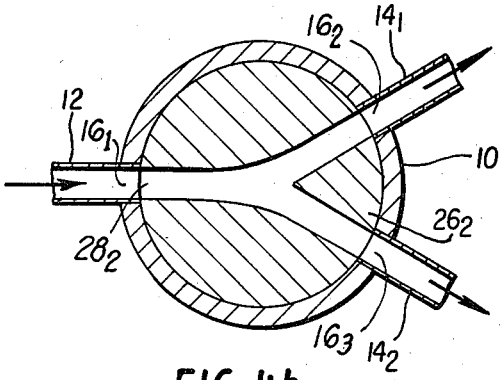
Figure 4C:
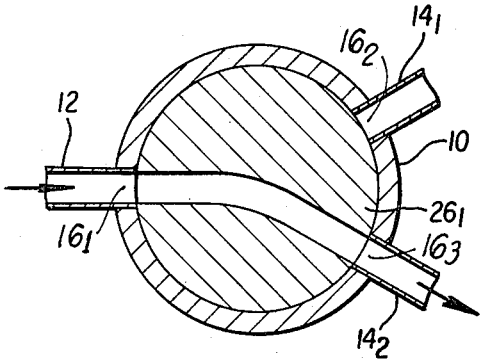

FIGS. 4*a*, 4*b* and 4*c* schematically illustrate the respective switching configurations respectfully enabled by positioning of disks $\mathbf{26}_n$, $\mathbf{26}_2$ and $\mathbf{26}_1$ in communication with housing ports $\mathbf{16}_1$, $\mathbf{16}_2$ and/or $\mathbf{16}_3$. In the switching configuration of FIG. 4*a* enabled by the selection of disk $\mathbf{26}_n$, neither of the air cylinders 42 and 44 is activated, and microwave energy is routed through disk $\mathbf{26}_n$ via housing ports $\mathbf{16}_1$ and $\mathbf{16}_2$. FIG. 4*b* depicts an advantageous construction based on the teachings of the invention as enabled by the provision of a disk $\mathbf{26}_2$ having an input port $\mathbf{28}_2$ constructed with a branched waveguide so that two housing ports $\mathbf{16}_2$ and $\mathbf{16}_3$ may be bridged by providing a proportioning or power splitting function upon selected translation of the assembly 18 such that the disk $\mathbf{26}_2$ is presented in communication with the several housing ports $\mathbf{16}_1$–$\mathbf{16}_3$. Similarly, FIG. 4*c* illustrates the switching configuration of the switch of the invention shown in FIG. 1 in the event of selective activation of air cylinder 44 and the resultant axial translation of disk $\mathbf{26}_1$ in communication with housing ports $\mathbf{16}_1$ and $\mathbf{16}_3$.

Figure 5A:
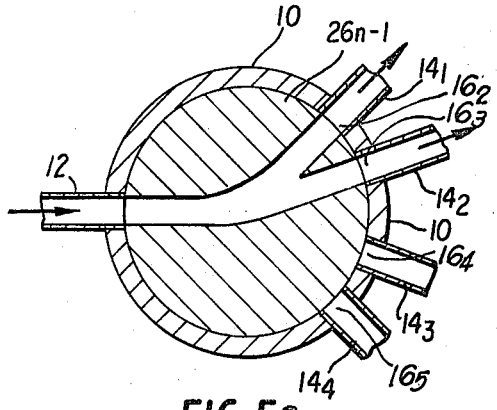
FIGS. 5*a*, 5*b* and 5*c* are semi-schematic views of three distinct waveguide switching configurations made possible by adding another housing output port to the switch shown in FIG. 1.
Figure 5B:
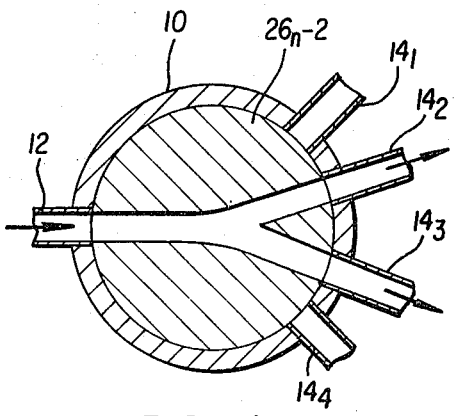
Figure 5C:
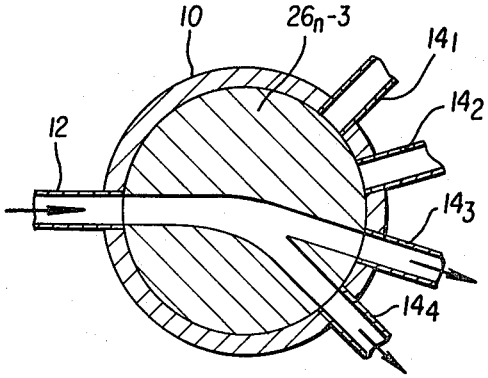

FIGS. 5*a*–5*c* illustrate a simple extension of the teachings of the invention, wherein four housing output ports $\mathbf{16}_2$–$\mathbf{16}_5$ are provided and wherein the disks $\mathbf{26}_{n-1}$, $\mathbf{26}_{n-2}$ and $\mathbf{26}_{n-3}$ of the invention define unique routing configurations to the ports $\mathbf{16}_2$–$\mathbf{16}_5$. Therefore, by selected translation of such a waveguide switching assembly 18, it is readily possible to accomplish the three different switching configurations shown in FIGS. 5*a*–5*c*.

Recapitulating, the multi-position waveguide switch of the invention is based on the concept of axial translation of a waveguide switching assembly provided with plural groups of respectively interconnected input and output ports spaced axially with respect to each other and disposed within a housing having plural waveguide ports. According to the invention, by selective axial translation of the waveguide switching assembly such that selected of the groups of input and output ports of the assembly 18 communicate with the housing ports, it is possible to derive the energy routing configurations defined by the respective groups of input and output ports and respective waveguide sections. By locating each of the groups of input and output ports and associated waveguide sections in a separate disk, simplicity of construction is assured, with a built-in flexibility of operation as enabled by addition, deletion, and/or replacement of disks defining different switching configurations. Furthermore, the switching so enabled by the invention advantageously enables direct switching between chosen paths without the necessity of pausing in an unwanted intermediate switching configuration.

Numerous modifications and variations of the invention are possible in light of the above teachings. For example, the invention is highly adaptable to more complicated microwave switching applications, whereby virtually any number of housing ports can be interconnected. Whereas the preferred embodiments discussed above envision a single disk input port in communication with a single housing port, it is highly conceivable that the disks of the switching assembly of the invention could involve plural input ports in communication with plural housing ports. Furthermore, while each disk as described above implements an energy routing configuration in a single plane transverse to the longitudinal axis of the housing, it is readily understood that the disks may be readily implemented with input ports not lying in the same plane connected to output ports similarly not lying in a common plane by means of respective waveguide sections. In that regard, it is noted that whereas in the preferred embodiment the waveguide switching assembly 18 is formed of separate disks 26, the invention may otherwise be practiced by means of an integrally formed switching assembly having the requisite waveguide channels passing therethrough. Furthermore, while the translation mechanism of the invention relies of a source of pressurized air for driving the air cylinders, it is readily understood that other translation mechanisms may also be utilized in practicing the invention.

Obviously, numerous additional modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A multi-position waveguide switch comprising:

a housing defining a longitudinal axis and having plural ports and communication with waveguides extending from said housing;

a waveguide switching assembly disposed in said housing and including plural waveguide channels each having at least one input port and at least one output port, wherein at least two of said channels are displaced axially a predetermined distance, said input and output ports positioned relative to predetermined of said housing ports such that upon selected axial translation of said waveguide switching assembly, selected of said input and output ports are aligned and in communication with said predetermined housing ports;

means for selectively axially translating said waveguides switching assembly such that selected of said input and output ports are aligned and in communication with said predetermined housing ports; wherein said translating means comprising;

spring means coupling said housing and said waveguide switching assembly for biasing said assembly in a first direction;

displacement means coupled to said waveguide switching assembly for selectively translating said assembly in a second direction opposite said first direction against the bias of said spring means;

wherein said displacement comprises at least one air cylinder having a piston coupled to said waveguide switching assembly, said cylinder adapted to be connected to a source of pressurized air such that upon application of pressurized air thereto, said piston and said assembly undergoes a predetermined translation; and plural air cylinders each having a piston coupled to said waveguide switching assembly, and each adapted to be connected to a source of pressurized air, each piston having a respective stroke, wherein selective application of pressurized air to a selected air cylinder produces a predetermined translation of the respective piston and said assembly in dependence on the stroke of said respective piston.

2. A switch according to claim 1, further comprising:

said input and output ports of said waveguide switching assembly arranged in respective groups including at least one input port and at least one output port coupled to said at least one input port via said waveguide channel;

the input ports of each group having an identical spacial relationship such that corresponding input ports of each group are aligned with respective housing ports upon axial translation of said assembly, and the output ports of each group positioned to couple predetermined housing ports to define a unique switching configuration through said housing for each group of input and output ports of said waveguide switching assembly.

* * * * *